US008292572B2

(12) United States Patent
Phlegm et al.

(10) Patent No.: US 8,292,572 B2
(45) Date of Patent: Oct. 23, 2012

(54) BLOWER MOTOR FLANGE DIVERTER

(75) Inventors: Herman K. Phlegm, Oak Park, MI (US); Pablo Valencia, Jr., Northville, MI (US); John G. Dorrough, Oak Park, MI (US); Ronald A. Lemmon, Amherst, NY (US); Terrence P. Wilson, El Paso, TX (US)

(73) Assignee: GM Global Technology Operations LLC, Detroit, MI (US)

( * ) Notice: Subject to any disclaimer, the term of this patent is extended or adjusted under 35 U.S.C. 154(b) by 1287 days.

(21) Appl. No.: 12/014,129

(22) Filed: Jan. 15, 2008

(65) Prior Publication Data

US 2009/0180870 A1 Jul. 16, 2009

(51) Int. Cl.
*F04D 29/70* (2006.01)
*F04D 29/44* (2006.01)

(52) U.S. Cl. ..... 415/169.3; 417/423.14

(58) Field of Classification Search ..... 415/1, 169.2, 415/169.3, 211.2, 221; 417/423.14, 423.9, 417/423.11

See application file for complete search history.

(56) References Cited

U.S. PATENT DOCUMENTS 7,699,587 B2 * 4/2010 Chapman et al. ..... 417/370
2008/0199311 A1 * 8/2008 Lindner et al. ..... 415/204

FOREIGN PATENT DOCUMENTS

JP 7167087 A * 4/1995
JP 2007154856 A * 6/2007

* cited by examiner

*Primary Examiner* — Edward Look
*Assistant Examiner* — Jesse Prager

(57) ABSTRACT

A blower motor assembly for use in a heating, ventilation and air-conditioning system of a vehicle and a method of diverting water are disclosed. The blower motor assembly may include a motor housing, configured to surround internal components of the blower motor assembly, and including a cooling channel/air intake opening. The blower motor assembly may also include a motor support flange extending radially outward from the motor housing and having an upward facing surface, and at least one water diversion vane extending upward from the upward facing surface and extending radially outward in an arcuate shape to divert water off of the flange.

13 Claims, 3 Drawing Sheets

20
30
32
28
24
40
42
54
22
51
46
38
34
36
26

BLOWER MOTOR FLANGE DIVERTER

BACKGROUND OF INVENTION

The present invention relates generally to vehicle heating, ventilation and air-conditioning (HVAC) systems, and more particularly to a blower motor for a HVAC system.

In some vehicle HVAC systems, a blower motor assembly is oriented with its motor shaft extending upward and is located below an air inlet opening. As the motor turns a blower, air may be sucked from the exterior of the vehicle through the air inlet and then directed into a heat exchanger module. Under certain conditions, it is possible to have water intrusion through this air inlet. For example, this may occur when the vehicle is traveling through a car wash while the blower motor is operating and a recirculation door is positioned to allow for incoming air flow from outside of the vehicle. This water may land on a motor support flange extending around the motor. Water resting on this support flange may end up flowing into a cooling tube of the motor, which would allow the water to get into the inner workings of the motor. If water gets into the motor itself, then the motor can become inoperable, thereby rendering the HVAC system inoperable.

SUMMARY OF INVENTION

An embodiment contemplates a blower motor assembly for use in a heating, ventilation and air-conditioning system of a vehicle. The blower motor assembly may comprise a motor housing surrounding internal components of the blower motor assembly and including a cooling channel/air intake opening; a motor support flange extending radially outward from the motor housing and having an upward facing surface; and a first water diversion vane extending upward from the upward facing surface and extending radially outward in an arcuate shape, with the first water diversion vane being adjacent to the cooling channel/air intake opening.

An embodiment contemplates a heating, ventilation and air-conditioning system for use in a vehicle. The HVAC system may comprise a module housing and a fan assembly. The module housing may have an air inlet opening configured to accept air flow from outside of the vehicle. The fan assembly may include a blower motor assembly and a blower operatively engaging the blower motor assembly, with the fan assembly located below the air inlet opening. The blower motor assembly may include a motor housing, a motor support flange extending radially outward from the motor housing and having an upward facing surface, and a first water diversion vane extending upward from the upward facing surface and extending radially outward in an arcuate shape that curves in a direction of rotation of the blower as the first water diversion vane extends radially outward.

An embodiment contemplates a method of diverting water off of a motor support flange of a blower motor assembly located below an air inlet opening in a vehicle heating, ventilation and air-conditioning system, the method comprising the steps of: actuating a motor to drive a blower in a predetermined direction of rotation to draw air and air mixed with water through the air inlet opening; allowing the water to settle on an upward facing surface of the motor support flange; and directing the water, along a water diversion vane extending upward from the upward facing surface, radially outward along a curved path having curvature in the direction of rotation of the blower.

An advantage of an embodiment is the water diversion vanes that divert water (and other liquids) that may enter the HVAC system away from the blower motor in order to keep water from entering the motor. This reduces the likelihood that water will enter the motor and damage motor interior components.

DETAILED DESCRIPTION

Figure 1:
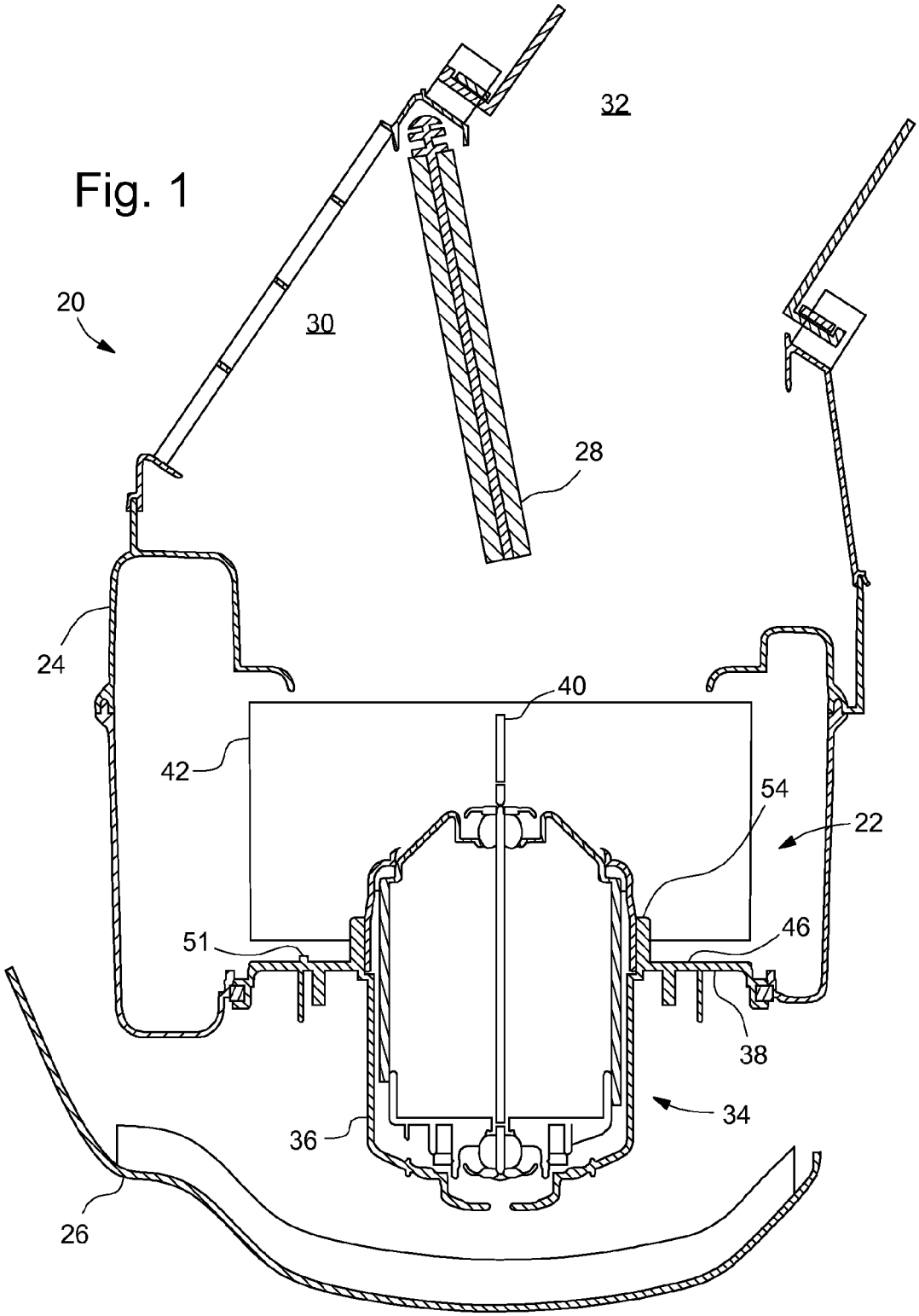
FIG. 1 is a schematic, cross-section view of a portion of a vehicle HVAC system.
Figure 2:
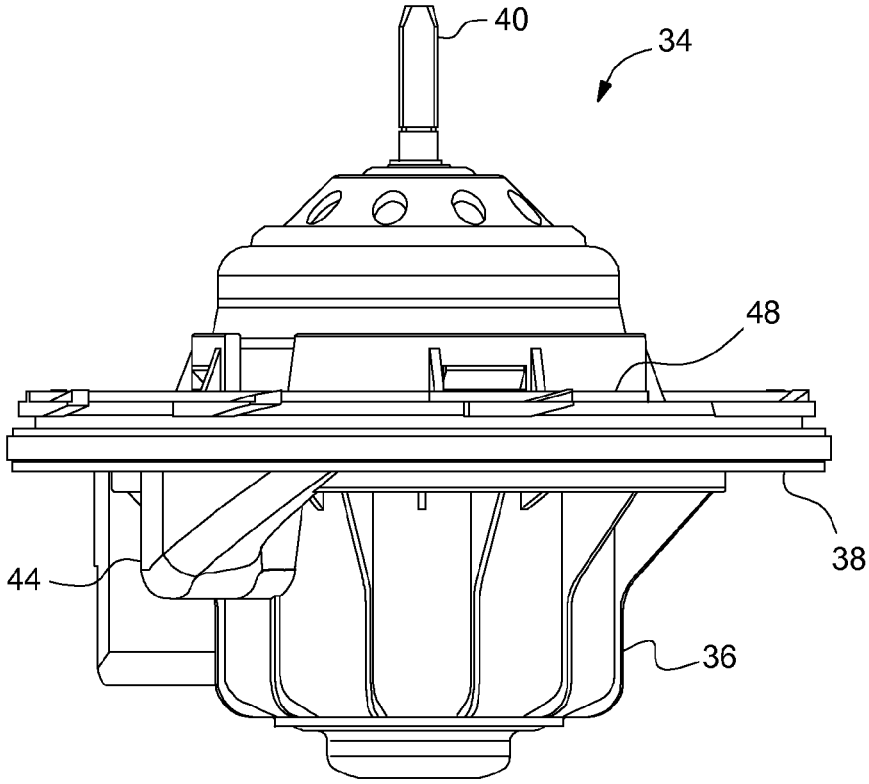
FIG. 2 is a side view, on an enlarged scale, of a motor employed in the HVAC system of FIG. 1.
Figure 3:
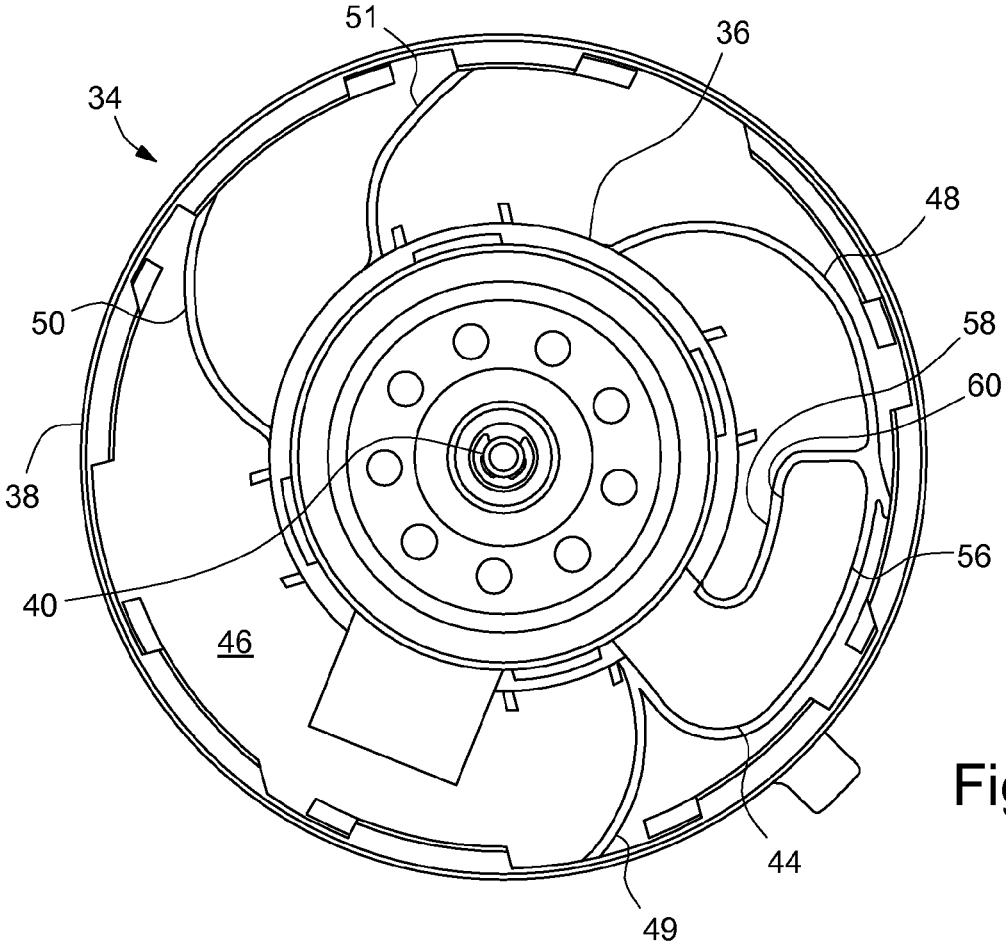
FIG. 3 is a plan view, on an enlarged scale, of the motor of FIG. 3.

Referring to FIGS. 1-3, a vehicle HVAC system, indicated generally at 20, is shown. The HVAC system 20 includes a fan assembly 22, located in a module scroll housing 24 and above a hush panel 26. The module scroll housing 24 includes a recirculation door 28 that can pivot between a recirculated air opening 30 and an air inlet opening 32. The air inlet opening 32 allows air to be drawn in from outside of the vehicle. The fan assembly 22 is located below the air inlet opening 32.

The fan assembly 22 includes a blower motor assembly 34 having a housing 36 from which a motor support flange 38 extends radially outward. The motor support flange 38 connects to portions of the module scroll housing 24 in order to support the fan assembly 22. A motor shaft 40 extends vertically upward from the blower motor assembly 34 and engages a blower 42. The housing 36 also includes a cooling channel/air intake opening 44, which extends from outside the housing 36 along the motor support flange 38 into the inner components (not shown in detail herein) of the motor 34.

The motor support flange 38 includes an upward facing surface 46, which faces toward the blower 42. A portion of the motor support flange 38 may be located directly below the air inlet opening 32. A first water diversion vane 48, a second water diversion vane 49, a third water diversion vane 50 and a fourth water diversion vane 51 extend upward from the upward facing surface 46 of the motor support flange 38. Each vane 48-51 may extend from the upward facing surface 46 about two millimeters. Each vane 48-51 also has a clockwise curvature as it extends radially outward from an inner vertical flange 54 (as seen looking down on the motor in FIG. 3). The clockwise curvature is related to the direction of rotation of the blower 42. If the blower 42, for some reason, were configured to rotate in the opposite direction, then the vanes 48-51 may instead have a counterclockwise curvature as they extend radially outward.

The first water diversion vane 48 is located adjacent to the cooling channel/air intake opening 44. The first water diversion vane 48 may have greater curvature than the other three and extend a greater distance so that it extends around a radially outer edge 56 of the opening 44. The first water diversion vane 48 may additionally include an opening surround portion 58 that extends around a radially inner edge 60 of the opening 44 in order to provide additional protection from water intrusion into the opening 44.

The operation of the HVAC system 20 will now be discussed. The motor assembly 34 is activated, which causes the motor shaft 40 to rotate the blower 42. Rotation of the blower 42 draws air in through the recirculated air opening 30, air inlet opening 32 or both. Under certain vehicle operating conditions, air drawn in through the air inlet opening 32 includes some water. As this air/water mixture is drawn through the blower 42, some of the water may settle out onto the upward facing surface 46 of the motor support flange 38. Some of the air coming from the blower will impinge upon the upward facing surface 46, which may cause the water to move somewhat in a clockwise direction (as viewed in FIG. 3) due to the direction of rotation of the blower 42. As this water moves along the upward facing surface 46, it will impinge upon one of the diversion vanes 48-51 (if it does not fall off an outer radial edge of the motor support flange 38 first). As the air flow continues, then, the particular vane 48-51 will direct the water radially outward as it travels along the curved leading edge of the vane 48-51 until it falls off the outer radial edge of the motor support flange 38. Thus, the water will not build up on the flange and is prevented from flowing down into the cooling channel/air intake opening 44.

Figure 4:
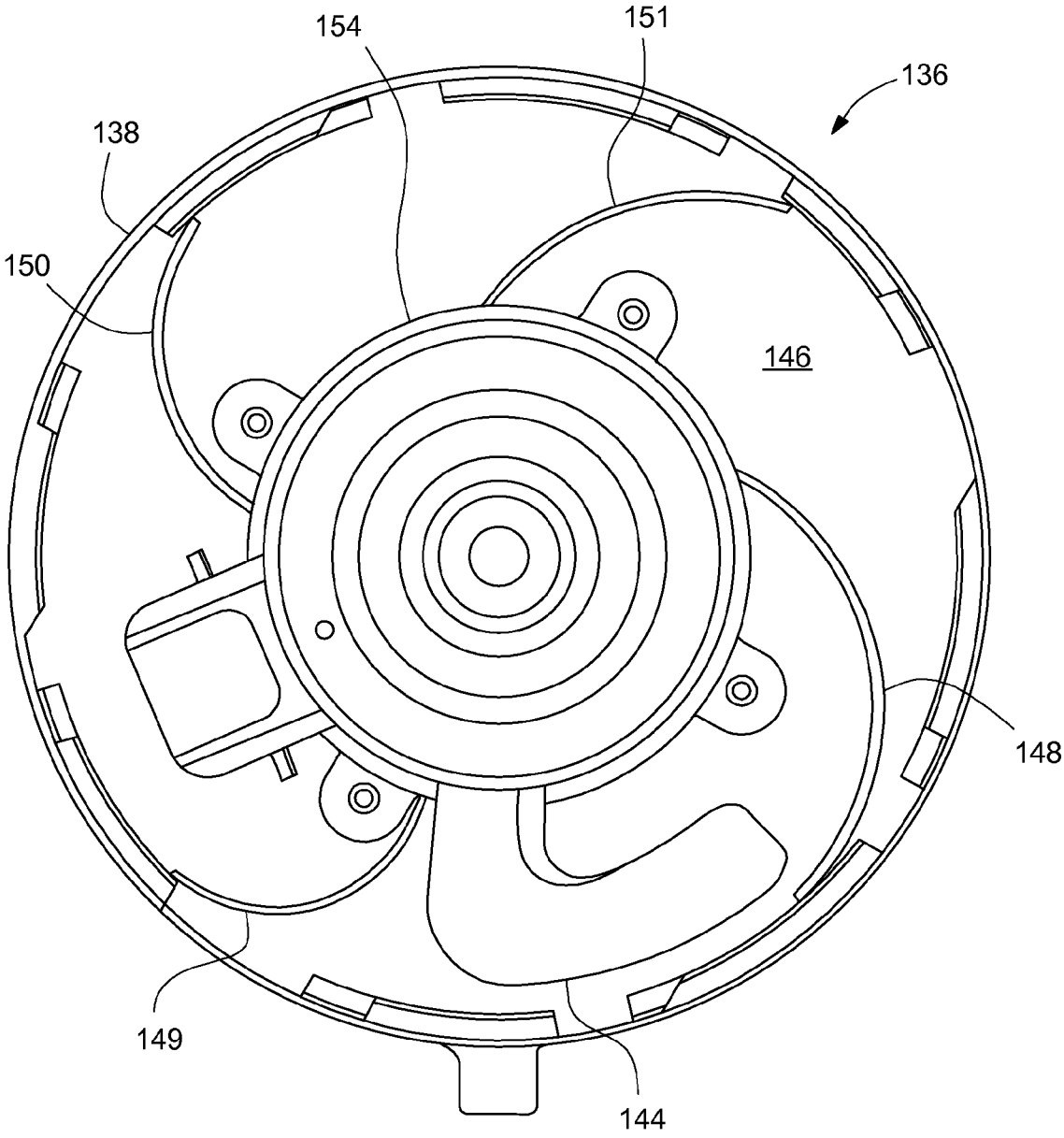
FIG. 4 is a schematic, plan view of a portion of a motor according to a second embodiment.

FIG. 4 illustrates a second embodiment. Since this embodiment is similar to the first, similar element numbers will be used for similar elements, but employing 100-series numbers. In this embodiment, the shapes and orientations of the water diversion vanes 148-151 extending from the upward facing surface 146 of the motor support flange 138 are changed somewhat. The vanes 148-151 still curve in the direction of rotation of the blower (not shown in this figure) as they extend radially outward from the inner vertical flange 154, but the first water diversion vane 148 does not extend all of the way around the cooling channel/air intake opening 144. However, water is still diverted off of the motor housing 136, thus avoiding damage that might otherwise occur with water intrusion into the motor.

While certain embodiments of the present invention have been described in detail, those familiar with the art to which this invention relates will recognize various alternative designs and embodiments for practicing the invention as defined by the following claims.

What is claimed is:

1. A blower motor assembly for use in a heating, ventilation and air-conditioning system of a vehicle comprising:

a motor housing, configured to surround internal components of the blower motor assembly, and including a cooling-channel-and-air-intake opening;

a motor support flange extending radially outward from the motor housing and having an upwardly extending inverter flange contacting the motor housing and an upward facing surface extending radially outward from the inner vertical flange; and a first water diversion vane extending upward from the upward facing surface and extending radially outward from the inner vertical flange in an arcuate shape, the first water diversion vane being adjacent to the cooling-channel-and-air-intake opening.

2. The blower motor assembly of claim 1 including a second water diversion vane extending upward from the upward facing surface and extending radially outward in an arcuate shape, the second water diversion vane being circumferentially spaced from the first water diversion vane.

3. The blower motor assembly of claim 2 including a third water diversion vane extending upward from the upward facing surface and extending radially outward in an arcuate shape, the third water diversion vane being circumferentially spaced from the first and second water diversion vanes.

4. The blower motor assembly of claim 3 including a fourth water diversion vane extending upward from the upward facing surface and extending radially outward in an arcuate shape, the fourth water diversion vane being circumferentially spaced from the first, second and third water diversion vanes.

5. The blower motor assembly of claim 1 wherein the first water diversion vane has a height above the upward facing surface of two millimeters.

6. The blower motor assembly of claim 1 wherein the first water diversion vane includes an opening surround portion extending around a radially inner portion of the cooling-channel-and-air-intake opening.

7. A heating, ventilation and air-conditioning system for use in a vehicle comprising:

a module housing having an air inlet opening configured to accept air flow from outside of the vehicle; and a fan assembly including a blower motor assembly and a blower operatively engaging the blower motor assembly, the fan assembly located below the air inlet opening;

wherein the blower motor assembly includes a motor housing, a motor support flange extending radially outward from the motor housing and having an upward extending inner vertical flange contacting the motor housing and an upward facing surface extending radially outward from the inner vertical flange, and a first water diversion vane extending upward from the upward facing surface and extending radially outward from the inner vertical flange in an arcuate shape that curves in a direction of rotation of the blower as the first water diversion vane extends radially outward.

8. The heating, ventilation and air-conditioning system of claim 7 wherein the motor housing includes a cooling-channel-and-air-intake opening, the first water diversion vane being adjacent to and extending around a portion of the intake cooling-channel-and-air-intake opening.

9. The heating, ventilation and air-conditioning system of claim 8 wherein the first water diversion vane includes an opening surround portion extending around a radially inner portion of the cooling-channel-and-air-intake opening.

10. The heating, ventilation and air-conditioning system of claim 7 including a second water diversion vane extending upward from the upward facing surface and extending radially outward in an arcuate shape that curves in a direction of rotation of the blower as the second water diversion vane extends radially outward, the second water diversion vane being circumferentially spaced from the first water diversion vane.

11. The heating, ventilation and air-conditioning system of claim 10 including a third water diversion vane extending upward from the upward facing surface and extending radially outward in an arcuate shape that curves in a direction of rotation of the blower as the third water diversion vane extends radially outward, the third water diversion vane being circumferentially spaced from the first and second water diversion vanes.

12. The heating, ventilation and air-conditioning system of claim 11 including a fourth water diversion vane extending upward from the upward facing surface and extending radially outward in an arcuate shape that curves in a direction of rotation of the blower as the fourth water diversion vane extends radially outward, the fourth water diversion vane being circumferentially spaced from the first, second and third water diversion vanes.

13. The heating, ventilation and air-conditioning system of claim 7 wherein the first water diversion vane has a height above the upward facing surface of two millimeters.

* * * * *